United States Patent [19]

Grotepass

[11] Patent Number: 5,050,418

[45] Date of Patent: Sep. 24, 1991

[54] BAR STEEL ROLLING MILL WITH A COOLING SEGMENT FOR THERMOMECHANICAL FINISH ROLLING

[75] Inventor: Johann Grotepass, Ratingen, Fed. Rep. of Germany

[73] Assignee: SMS Schloemann Siemag Aktiengesellschaft, Dusseldorf, Fed. Rep. of Germany

[21] Appl. No.: 403,591

[22] Filed: Sep. 5, 1989

[30] Foreign Application Priority Data

Sep. 5, 1988 [DE] Fed. Rep. of Germany ..... 3830101

[51] Int. Cl.[5] ..... B21B 1/18; B21B 31/08; B21B 45/02

[52] U.S. Cl. ..... 72/201; 72/239

[58] Field of Search ..... 72/200, 201, 238, 239

[56] References Cited

U.S. PATENT DOCUMENTS

| | | | |
|---|---|---|---|
| 3,665,746 | 5/1972 | Eibe | 72/239 |
| 3,979,939 | 9/1976 | Pazderka | 72/239 |
| 3,981,752 | 9/1976 | Kranenberg et al. | 148/12 B |
| 4,327,569 | 5/1982 | Hamanishi et al. | 72/239 |
| 4,791,799 | 12/1988 | Engel et al. | 72/239 X |
| 4,909,058 | 3/1990 | Bindernagel et al. | 72/201 |

FOREIGN PATENT DOCUMENTS

| | | | |
|---|---|---|---|
| 57-39014 | 3/1982 | Japan | 72/239 |
| 61-189803 | 8/1986 | Japan | 72/239 |

*Primary Examiner*—E. Michael Combs

*Attorney, Agent, or Firm*—Toren, McGeady & Associates

[57] ABSTRACT

In a bar steel rolling mill with a water-cooling segment upstream of a finishing train for thermomechanical finish rolling, respectively, one group of stands of an intermediate train or of intermediate trains, which is adjusted for rolling a larger finish cross-section than the smallest possible finish cross-section, is transferred to a stand location of the finish train, which has a water-cooling segment directly upstream of it. The finishing train for the smallest possible finished cross-section no longer needs to be refurbished to the larger finish cross-section, rather it is simply replaced by a group of stands from one or several intermediate trains, and rapid change devices are utilized for moving the strands and are all connected with each other by a pair of rails extending parallel to the rolling line up to at least one stand location of the finish train. A thermomechanical finish rolling of a larger finish cross-section being achieved without having to refurbish the finishing train to all desired finish cross-sections.

9 Claims, 1 Drawing Sheet

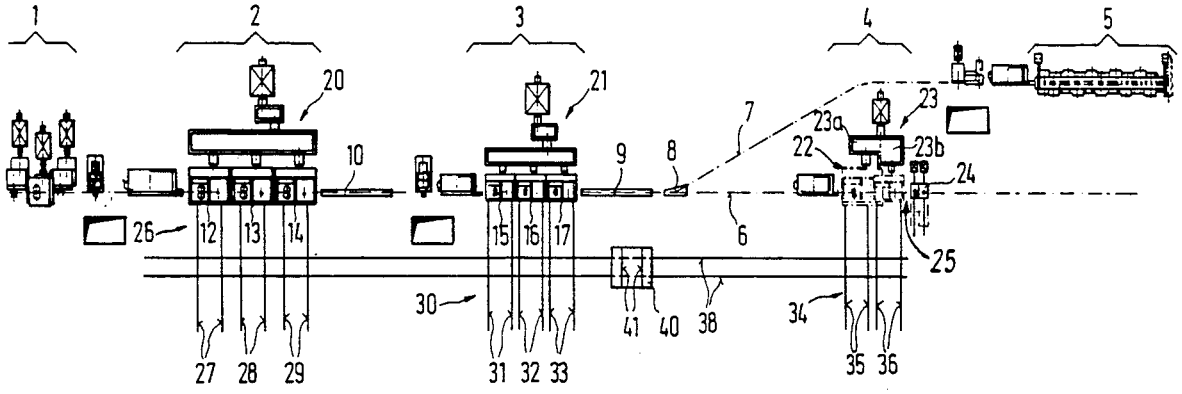

United States Patent Office

PTO - BOYERS, PA Duty Station

MISSING PAGE TEMPORARY NOTICE

PATENT # 5050418 FOR ISSUE DATE 9-24-91

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

DRAWING SHEET # 1

Data Conversion Operation

Boyers, Pa

BAR STEEL ROLLING MILL WITH A COOLING SEGMENT FOR THERMOMECHANICAL FINISH ROLLING

BACKGROUND OF THE INVENTION:

The invention is relates to a bar steel rolling mill as well as a method for operation thereof. The method includes providing rolling stands arranged on one pitch line or one axis of rolls, which are combined into one roughing train, at least one intermediate train and one finishing train, wherein a cooling segment for thermomechanical finish rolling located on the pitch line is located directly upstream of the finishing train. Thermomechanical finish rolling refers to cooling of the material to be rolled for all of the existing cross-sections to a comparatively low rolling temperature of approximately 750° C., so that finish-rolling is always at the same rolling temperature independent of the dimensions of the material to be rolled, in order to obtain a texture favorable for further processing and so as to suppress cinder formation (see, for example, DE 25 37 684 C2 and EP 0264 868 A2).

It is common in the art, when operating continuous bar steel- or wire steel rolling mills, to simply switch off an appropriate number of roll pairs, to open the sizing passes or to make entire roll stands ineffective by removing them, when changing from smaller finish cross-sections to larger finish cross-sections (DE 25 17 894 A1, second paragraph). This type of process can, however, not be reconciled with the principle of thermomechanical finish rolling for the reason that, for larger dimensions of material to be rolled, a series of roll stands of the intermediate train or intermediate trains are to already roll finished cross-sections, without the material to be rolled being previously cooled for thermomechanical finish rolling, since the cooling path is directly upstream of the stand location for the finish train for smallest dimensions, meaning it is downstream of all remaining stands. The only way out of this situation is to utilize the roll stands of the finish train for performing finishing passes for any dimensions of the material to be rolled, in order words, to respectively rebuild the finishing train when changing the program or to adapt it to the cross-section to be rolled by changing the stand. The possible advantage of being able to finish roll already on one rolling stand of the intermediate train or the intermediate trains is thereby lost.

SUMMARY OF THE INVENTION

Accordingly, it is an object of the present invention to eliminate the necessity for continuous adaptation of the finishing train to each finishing cross-section which has to be rolled in a bar steel rolling mill, and in spite of that of being able to perform the finishing pass or passes downstream of the cooling segment.

Pursuant to this object, and others which will become apparent hereafter, one aspect of the present invention results in a process, where, when rolling bar steel of a larger cross-section than the smallest possible cross-section, the finish train is removed from the rolling line and is replaced by a roll stand of the intermediate train or the intermediate trains by repositioning, which rolling train is set up to finish roll a larger bar steel cross-section. This permits utilization of any rolling stand or pair of rolls of the intermediate train or the intermediate trains, whose pass is set up to larger finish cross-sections than the smallest possible cross-section, as a finishing stand, downstream of the cooling segment, in order to roll any finish cross-section thermomechanically. A group of stands can also be meant by the term finishing stand.

In order to be able to finish roll any dimensions for rolling technology reasons in consecutive vertical and horizontal pairs of rolls, an intermediate train in a bar rolling mill for performing the above-mentioned process incorporates according to the present invention identical groups of stands with one pair of vertical- or horizontal rolls each. The groups of stands with their drives, including the drive motor, constitutes one constructional unit, and all groups of stands which have to be repositioned are equipped for operation in the stand location downstream of the cooling segment. This applies especially for the design of the pillars or columns for the groups of stands to be repositioned, which must all fit upon the floor plates of the stand position located downstream of the cooling segment. The stand position also accepts the finish train required for rolling the smallest cross-sections possible. Furthermore, all repositionable groups of stands must also be connectible, at the stand location of the finish train, to existing current-, water- and lubricant connections.

If the bar steel plant comprises two or more intermediate trains with different groups of stands which are, however, equal in each train, wherein the groups of stands of the first intermediate train following the roughing train is usually equipped with rolls of greater diameter than those of the following intermediate train, which are thus heavier than their rolling stands, then the invention provides, that accordingly two or more different stand locations for selectively receiving a group of stands including its own drive of the one or the other intermediate train is arranged downstream of the cooling segment, meaning that a suitable stand location is present for the heavier groups of stands as well as for the lighter groups of stands.

To the extent described up to now, the groups of stands to be relocated all have their own drive, so that no drives have to be provided at the location or locations of stands downstream of the cooling segment. However, things are different when one intermediate train consists of identical groups of stands with one pair each of vertical- and horizontal rolls, which are driven by a stationary group drive. In this case it is necessary to arrange that a stand location, appropriate for all groups of stands which have to be relocated with a drive fitting all of these groups of stands, is placed downstream of the cooling segment. In other words, all the groups of stands to be relocated must be connectible or coupleable to the drive assigned to the stand location downstream of the cooling segment.

Analogously to the version with groups of stands forming constructional units respectively with their own drive, the present invention provides in a bar steel rolling mill with two or more intermediate trains with different groups of stands which are, however, the same in each train but have different stationary group drives, that downstream of the cooling segment there are arranged two or more different stand locations with drives adapted to the group drives for selectively receiving a group of stands of the one or other intermediate train.

To the extent that up to now versions of bar steel trains for performing the method in the invention have been described, an overhead crane must be utilized for repositioning of groups of stands with individual- or group drive out of the intermediate train or trains into the stand locations arranged downstream of the cooling segment. The present invention however also teaches a way to reposition groups of stands without using a crane. In the case of a bar steel rolling mill for performing the inventive method, quick change devices are provided for the roll stands, which devices are equipped with traveling wheels, so that the rolling stands can be driven out of the rolling line over pairs of rails extending transversely to the rolling line and can be moved upon a carriage provided with a pair of rails. The carriage can then be moved upon a pair of rails extending parallel to the rolling line. The pairs of rails extending transversely to the rolling line are extended beyond the crossing regions with a pair of rails extending parallel to the rolling line. Such quick change devices are described in the DE 34 20 829 A1, FIG. 6. In the present invention these rapid change devices are refined in that all pairs of rails extending transversely to the rolling line are connected with each other by the pair of rails extending parallel to the rolling line. With this layout of quick change devices and for rolling larger cross-sections, the groups of stands which are not required can be driven, as is known, on the pairs of rails extending transversely to the rolling line up to their extensions into a parking or holding position or also for the purpose of exchanging rolls, and additionally, each group of stands to be repositioned can be driven back into the appropriate stand position of the finish train downstream of the cooling segment in the rolling line by means of the carriage and pair of rails extending up to the finish train, which rails extend parallel to the rolling line. Such a linking of quick change devices for each intermediate train and the finishing train can be applied advantageously also in a bar steel rolling plant, where it is not intended to finish roll thermomechanically, which thus is devoid of a cooling segment directly upstream of the finishing train.

Additionally, it is advisable for dimensionally correct finish rolling in the one or the several stand positions of the finishing train, that a group of stands be equipped with sizing pass rolls which can be driven out into a disassembly position behind the stand position or the stand positions. The group of stands with sizing pass rolls is selectively utilized especially when the material to be rolled is of small dimensions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 shows a layout of a bar steel and wire rolling mill pursuant to the present invention; and FIG. 2 is a diagrammatic illustration of a group of stands with its own drive.

DETAILED DESCRIPTION OF THE PREFERRED EMBODIMENT

The rolling mill depicted in FIG. 1 consists of a roughing train 1 with eight rolling stands, of which only three are depicted, an intermediate train 2, a lighter intermediate train 3, a finishing train 4 for bar steel and a wire finishing train 5. The roll stands of the roughing train 1, of the intermediate trains 2, 3 and the finishing train 4 are arranged on a straight rolling line 6, while the wire finishing train 5 is arranged on a rolling line 7 offset with respect to the rolling line 6. The material to be rolled can be diverted to the offset line 7 by a shunting arrangement 8. A water-cooling segment 9 for adjusting the temperature of the material to be rolled to a value of approximately 750° C. is located downstream of the intermediate train 3. The cooling segment 9 cools the material to be rolled so that the material to be rolled is finish rolled at a constant low temperature in the finish train 4 or the wire finish train 5 and in order to thus obtain a fine grain texture favorable for further processing.

The heavy intermediate train 2 consists of groups of stands 12, 13, 14 with vertical and horizontal pairs of rolls respectively, consecutively in the rolling direction, which stands are all driven by a common group drive 20. An additional water- cooling segment 10 is located downstream of the intermediate train 2.

The lighter intermediate train 3 consists of groups of stands 15, 16, 17, which differ from the groups of stands 12, 13, 14 of the intermediate train 2 merely in that roll diameter is smaller and thus the groups of stands are lighter. Accordingly, the group drive 21 is designed to be lighter than the group drive 20 of the intermediate train 2. The two stand locations 22 and 25 are provided for the steel bar-finish train 4, downstream of which a group of stands 24 with sizing pass rolls is arranged. For finish rolling of a steel bar of smallest dimension, the stand location 25 with a lighter group of stands is occupied, which location is not depicted in FIG. 1. It is intended to illustrate by broken dotted presentation of groups of stands in the stand locations 22 and 25, that one of the groups of stands 12, 13, or 14 of the heavy intermediate train 2 can be inserted into the stand location 22, while the stand location 25 is equipped to receive selectively one of the groups of stands 15, 16 or 17 of the light intermediate train 3. A group drive 23 serves for driving the group of stands from one of the intermediate trains 2 or 3, which can be transferred to the stand locations 22 and 25. The drive 23 is subdivided into a drive 23*a* for a group of stands of the heavy intermediate train 2 and a drive 23*b* for a group of stands of light intermediate train 3. Thus, the stand locations 22 and 25 are equipped not only for selectively receiving either groups of stands 12 to 14 or groups of stands 15 to 17, but these groups of stands are identical also as far as their roll stands, their drive couplings, and required current-, water- and lubricant connections, so that they are equipped so as to be transferred and fit into the stand locations 22 or 25.

A quick change device 26 is assigned to the heavy intermediate train 2, and consists of pairs of rails 27, 28 and 29 for each group of stands 12, 13, and 14, with the rails extending transversely to the rolling line 6. These pairs of rails cross a further pair of rails 38, which extends parallel to the rolling line 6 and upon which a trolley or carriage 40 with a pair of rails 41 is arranged so as to be displaceable thereon. A quick change device 30 is also assigned to the light intermediate train 3 and has pairs of rails 31, 32 and 33 extending transversely to the rolling line 6. Furthermore, the stand locations 22 and 25 are provided with pairs of rails 35, 36 for rolling groups of stands into and out of the stand locations. All of the rapid change devices 26, 30 and 34 are connected with each other by the pair of rails 38 extending parallel to the rolling line 6. The pairs of rails 27 to 29, 31 to 33 and 35 and 36 extending transversely to the rolling line 6 are extended beyond the region where they cross with the pair of rails 38.

The following process serves for operating the illustrated rolling mill:

When rolling bar steel of smallest dimensions, all stands of the roughing train 1 as well as of the intermediate trains 2 and 3 and the finish train 4 being utilized, and the stand location 25 is occupied by a group of stands driven by the drive 23*b*. The group stands 24 with sizing pass rolls is also in operation wherein it should be observed that this group of stands 24 can be moved out of the rolling line 6 over a pair of rails into a removal position 38, if the group is not required or has to be refurbished. In order to roll bar steel of a next larger dimension the group of stands located in the stand location 25 is driven into the extension of the pair of rails 36 beyond the crossing region with the pair of rails 38, in order to free the passage for the trolley or carriage 40 which is moved together with its pair of rails 41 in the line aligned with that pair of rails 31, 32 or 33, which is assigned to the group of stands 15, 16, 17, which are to be relocated. If, for instance, a group of stands 17 is adjusted to a delivery cross-section which is simultaneously the finished cross-section of the next larger bar steel dimension, this group of stands 17 is moved by the trolley 14 to the side of the stand location 25, in order to then be moved into the stand location 25. It is self-evident that the groups of stands are provided with traveling wheels, as they are depicted in FIG. 2 for a group of stands with its own drive. Instead of the single trolley 40 all groups of stands can be provided with movable trolleys serving as roll stand supports according to DE 34 20 829 A1, which movable trolleys have traveling wheels on split axles permitting displacement along as well as transversely to the rolling line 6.

If the group of stands 16 of the light intermediate train 3 can be used for the next larger bar steel dimension, the group of stands 17 located in the stand location 25 is brought back upon the trolley 40 and the trolley is moved up to the crossing region between the pairs of rails 33 and 38. The group of stands 17 is then moved upon the extensions of the pair of rails 33 into a sort of waiting position, in order to liberate the passage permitting the trolley to relocate the group of stands 16 into the stand location 25 with the trolley 40. All the other groups of stands 15, 14, 13 or 12 can be relocated as finishing stands into the stand locations 25 or 22 in the same manner, while the stand location 22, as has been stated, is reserved for the groups of stands 12 to 14 Of the heavy intermediate train 2, wherein the groups of stands 12, 13 or 14 are moved over the pairs of rails 35 into the stand location 22. All stands which are not required are in a standby position on the extension of the pairs of rails extending transversely to the rolling line 6 beyond the crossing region with the pair of rails 38 connect all the rapid change devices.

It is self-evident that each group of stands of the intermediate train is appropriately size-pass adjusted in such a way that the delivery cross-section is a finish cross-section appearing in the rolling schedule, which if required is merely processed subsequently by a sizing roll pass of the group of stands 24. Only this group of stands 24 including sizing roll passes is possibly to be refurbished to the respective bar steel dimensions. Depending on the breakdown of the rolling schedule it could be necessary to increase the number of the groups of stands in the intermediate trains 2 or 3, in order to always operates their groups of stands as the finishing train 4.

The essential advantage of the process in the invention which process can also be performed by repositioning groups of stands 15 to 17 or 12 to 14 by means of a crane, resides in that the finish passes are respectively performed downstream of the water-cooling segment 9, without the finish train having to be configured to the respective finish cross-section, for which purpose changing scaffolds must be made available for the finish train, if no refurbishing is to be carried out within the rolling line. The use of rapid change devices 26, 30 and 34 together with the pair of rails 38 connecting all the rapid change devices has not only the advantage that all work involving a crane is avoided, but it also makes it possible to work in a conventional manner with change scaffolds, thus, saving stand locations in the intermediate trains 2 and 3. Furthermore, special trenches are built expediently instead of the groups of stands which are not required in the intermediate trains.

In order to roll wire dimensions the switching arrangement 8 is actuated in order to divert the material to be rolled into the offset line 7.

While the invention has been illustrated and described as embodied in a bar steel or wire rolling mill and method for operation thereof, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

I claim:

1. A bar steel rolling mill, comprising:

rolling stands arranged in a roll line and combined into a roughing train, at least one intermediate train, and one finishing train; and a cooling segment arranged in the rolling line directly upstream of the finishing train for thermomechanical finish rolling, the at least one intermediate line including identical stands or groups of stands each with one pair of vertical rolls and horizontal rolls, stands of the at least one intermediate line being adjusted to a larger rolled cross-section than a cross-section of stands of the finishing train in the rolling line, the stands of the at least one intermediate train being identical to the stands of the finishing line, and forming a structural unit with drives including a drive motor, the stands of the intermediate line being configured so as to be repositionable for operation in a stand location downstream of the cooling segment in place of the stands of the finishing line so that when bar steel is rolled with a next larger dimension exceeding a rolled dimension possible with the finishing train, one stand in the finishing train can be removed and replaced by a stand from the intermediate train.

2. A bar steel rolling mill according to claim 10, wherein the finishing train is removable from the rolling line, and a roll stand from the at least one intermediate train being relocatable into the position vacated by removal of the finishing train, all groups of stands to be relocated being configured so as to be operable in a stand location downstream of the cooling segment.

3. A bar steel rolling mill according to claim 2, wherein at least two intermediate trains are provided which have different groups of stands but are identical in each train, at least two different stand locations being arranged downstream of the cooling segment for selectively receiving one group of stands together with its own drive from one of the intermediate trains.

4. A bar steel rolling mill according to claim 2, and further comprising rapid change means for moving the rolling stands out of the rolling line, said rapid change means including wheels provided on the stands, pairs of rails extending transversely to the rolling line, said wheels engaging said pairs of rails so that the stands can be rolled out of the rolling line, and a trolley having a pair of rails and being arranged so that a rolled out stand can be shifted thereon, the trolley being displaceable upon a pair of rails extending parallel to the rolling line, the pairs of rails extending transversely to the rolling line being extended beyond regions in which they cross the pair of rails extending parallel to the rolling line, all of the pairs of rails extending transversely to the rolling line being connected with each other by the pair of rails extending parallel to the rolling line.

5. A bar steel rolling mills according to claim 2, and further comprising an additional group of stands with sizing pass rolls arranged downstream of the stand location, said additional group of stands being movable into a removal position.

6. A bar steel rolling mill according to claim 1, wherein the finishing train is removable from the rolling line, and a roll stand from the at least one intermediate train being relocatable into the position vacated by removal of the finishing train, the groups of stands of the at least intermediate train being driven by a stationary group, and further comprising a stand location, suitable for all groups of stands to be relocated, having a drive suitable for these groups of stands located downstream of the cooling segment.

7. A bar steel rolling mill according to claim 6, wherein at least two or more intermediate trains are provided which have different groups of stands but are identical in each train, each of said intermediate trains having a different stationary group drive, at least two different stand locations with drives adapted to the group drives being arranged downstream of the cooling segment for selective reception of one group of stands from one of the intermediate trains.

8. A bar steel rolling mill according to claim 6, and further comprising rapid change means for moving the rolling stands out of the rolling line, said rapid change means including wheels provided on the stands, pairs of rails extending transversely to the rolling line, said wheels engaging said pairs of rails so that the stands can be rolled out of the rolling line, and a trolley having a pair of rails and being arranged so that a rolled out stand can be shifted thereon, the trolley being displaceable upon a pair of rails extending parallel to the rolling line, the pairs of rails extending transversely to the rolling line being extended beyond regions in which they cross the pair of rails extending parallel to the rolling line, all of the pairs of rails extending transversely to the rolling line being connected with each other by the pair of rails extending parallel to the rolling line.

9. A bar steel rolling mills according to claim 6, and further comprising an additional group of stands with sizing pass rolls arranged downstream of the stand location, said additional group of stands being movable into a removal position.

* * * * *